US007415357B1

(12) United States Patent
Stluka et al.

(10) Patent No.: US 7,415,357 B1
(45) Date of Patent: Aug. 19, 2008

(54) AUTOMATED OIL WELL TEST CLASSIFICATION

(75) Inventors: Petr Stluka, Prague (CZ); Karel Marik, Revnice (CZ); Josef Rieger, Jilemnice (CZ)

(73) Assignee: Honeywell International inc., Morristown, NJ (US)

( * ) Notice: Subject to any disclaimer, the term of this patent is extended or adjusted under 35 U.S.C. 154(b) by 0 days.

(21) Appl. No.: 11/683,233

(22) Filed: Mar. 7, 2007

(51) Int. Cl.
*G06F 19/00* (2006.01)

(52) U.S. Cl. ..... 702/6; 700/25; 235/449

(58) Field of Classification Search ..... 702/6, 702/14, 182–185, 187–189; 235/449
See application file for complete search history.

(56) References Cited

U.S. PATENT DOCUMENTS

2007/0295501 A1* 12/2007 Poulisse ..... 166/250.01

* cited by examiner

*Primary Examiner*—Edward Raymond
(74) *Attorney, Agent, or Firm*—Kris T. Fredrick

(57) ABSTRACT

The subject mater herein relates to oil well testing and, more particularly, automated oil well test classification. Various embodiments described herein provide systems, methods, and software for statistical analysis and classification of oil well tests. Some embodiments include receiving a first set of oil well test results from one or more measurement devices of a well test separator, storing the first set of oil well test results in a database, and annotating one or more tests of the first set oil well test results. The annotated test results are then used to build one or more classification models to enable automated oil well test classification as new oil well tests are performed.

16 Claims, 7 Drawing Sheets

200
202
210
204
225
PROGRAM
206
PROCESSING UNIT
VOLATILE
208
NON-VOLATILE
220
212
REMOVABLE STORAGE
COMMUNICATION CONNECTION
216
218
NON-REMOVABLE STORAGE
INPUT
OUTPUT
214
NETWORK
DATABASE
112
WELL TEST SEPARATOR
WATER METER
114
EMULSION METER
116
EMULSION RATIO
118
232
230

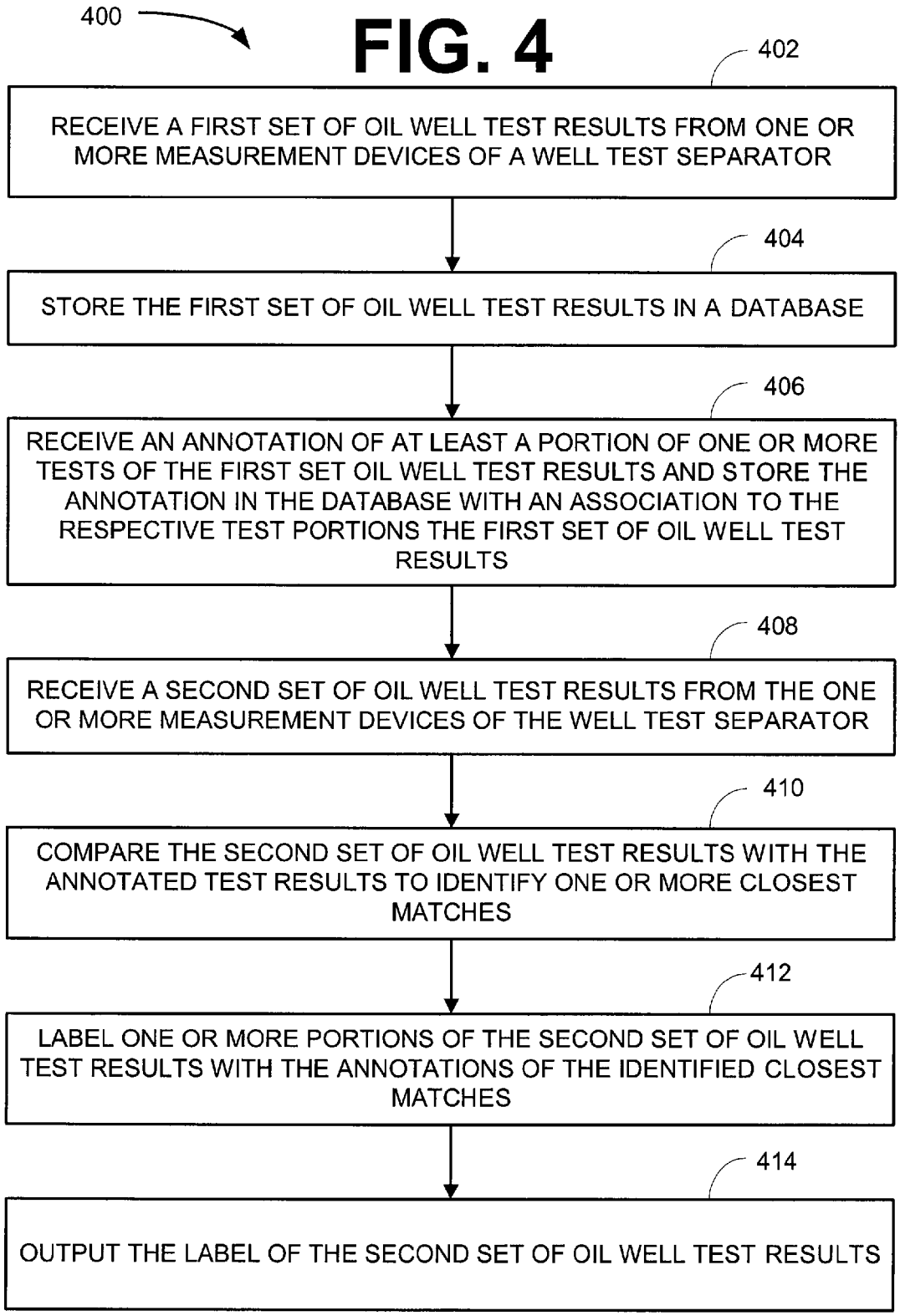
400
FIG. 4
402
RECEIVE A FIRST SET OF OIL WELL TEST RESULTS FROM ONE OR MORE MEASUREMENT DEVICES OF A WELL TEST SEPARATOR
404
STORE THE FIRST SET OF OIL WELL TEST RESULTS IN A DATABASE
406
RECEIVE AN ANNOTATION OF AT LEAST A PORTION OF ONE OR MORE TESTS OF THE FIRST SET OIL WELL TEST RESULTS AND STORE THE ANNOTATION IN THE DATABASE WITH AN ASSOCIATION TO THE RESPECTIVE TEST PORTIONS THE FIRST SET OF OIL WELL TEST RESULTS
408
RECEIVE A SECOND SET OF OIL WELL TEST RESULTS FROM THE ONE OR MORE MEASUREMENT DEVICES OF THE WELL TEST SEPARATOR
410
COMPARE THE SECOND SET OF OIL WELL TEST RESULTS WITH THE ANNOTATED TEST RESULTS TO IDENTIFY ONE OR MORE CLOSEST MATCHES
412
LABEL ONE OR MORE PORTIONS OF THE SECOND SET OF OIL WELL TEST RESULTS WITH THE ANNOTATIONS OF THE IDENTIFIED CLOSEST MATCHES
414
OUTPUT THE LABEL OF THE SECOND SET OF OIL WELL TEST RESULTS

AUTOMATED OIL WELL TEST CLASSIFICATION

TECHNICAL FIELD

The subject mater herein relates to oil well testing and, more particularly, automated oil well test classification.

BACKGROUND INFORMATION

Testing of oil wells, which are located in one production facility, generates a stream of measurements that are taken continually on well test separator equipment and associated piping system. If efficiently processed, this data stream can indicate specific operational issues, such as faults, influences between adjacent wells, and changing reservoir conditions. Wells of a given production facility are tested in a closed sequence and each test takes a specified time interval. Usually, there are multiple relevant characteristics that must be taken into account. Primarily, the test-internal time series sampled during the specified time interval characterize the test itself. The representative statistical characteristics should also be compared with the long-term production trends on a given well. There are also faults—such as when oil is being dumped out the water leg—that introduce specific features into the data stream. In general, the analysis of the well test data stream is a complex task and is primarily performed manually. Given the number of wells in a typical production facility, it is difficult to perform the analysis efficiently and in a timely manner.

BRIEF DESCRIPTION OF THE DRAWINGS

FIG. 4 is a block diagram of a method according to an example embodiment.

DETAILED DESCRIPTION

Figure 1:
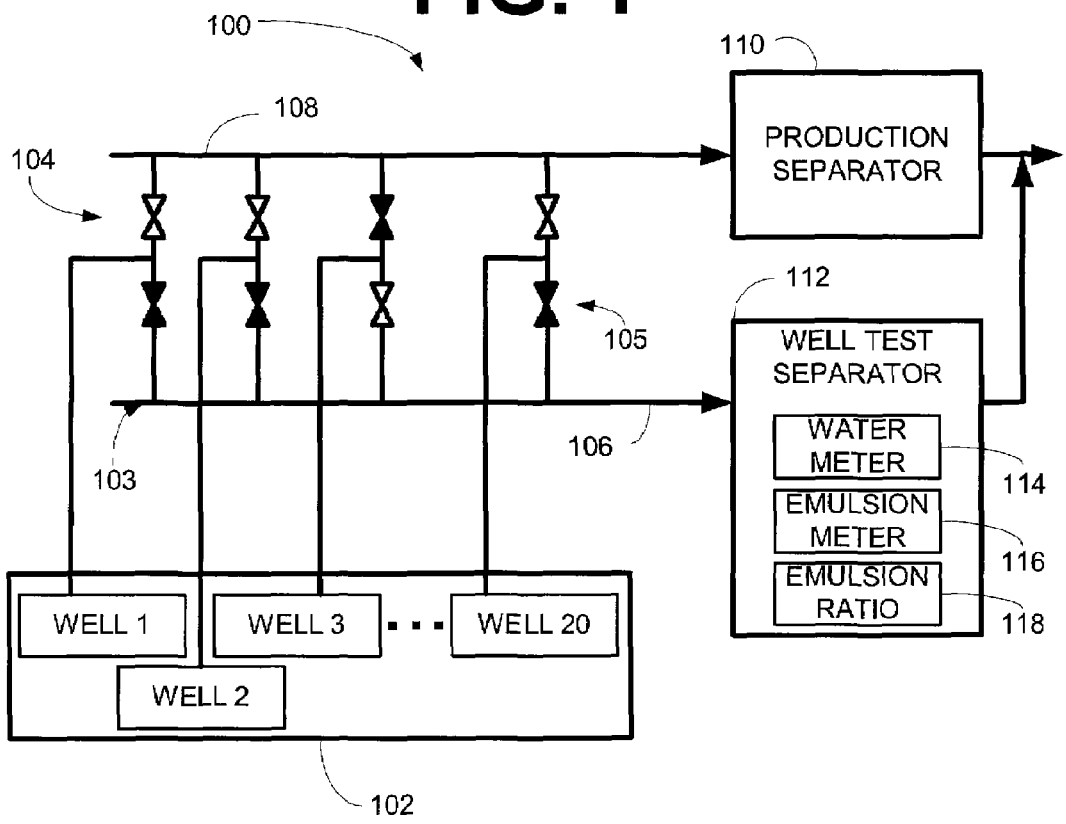
FIG. 1 is a block diagram of a oil production facility according to an example embodiment.

Various embodiments described herein provide systems, methods, and software for statistical analysis and classification of oil well tests. In one such embodiment, a system is composed of three parts. The first part is a repository of historical well tests that are provided with annotation added after manual review of the previous operation on a selected few representative wells. The second part is a set of classification models that do a comparison of a new test with the tests stored in the repository. These models, in some embodiments, are of three types: (a) models that match time series curves of oil and water flow rates with the curves stored in the repository; (b) models that compare long-term production trends on a given well with historical trends stored in the repository; (c) models that detect features of specific faults. The output of each model is a general indication of normality or abnormality of the new test, and may be accompanied by an indication of a specific fault. The third part of the system of this embodiment is the application of logic that applies all three types of classification models to the new test, combines their results, and presents them to an operator who may take corrective actions to correct any identified faults. This and other embodiments are described in greater detail below.

In the following detailed description, reference is made to the accompanying drawings that form a part hereof, and in which is shown by way of illustration specific embodiments in which the inventive subject matter may be practiced. These embodiments are described in sufficient detail to enable those skilled in the art to practice them, and it is to be understood that other embodiments may be utilized and that structural, logical, and electrical changes may be made without departing from the scope of the inventive subject matter. Such embodiments of the inventive subject matter may be referred to, individually and/or collectively, herein by the term "invention" merely for convenience and without intending to voluntarily limit the scope of this application to any single invention or inventive concept if more than one is in fact disclosed.

The following description is, therefore, not to be taken in a limited sense, and the scope of the inventive subject matter is defined by the appended claims.

The functions or algorithms described herein are implemented in hardware, software or a combination of software and hardware in one embodiment. The software comprises computer executable instructions stored on computer readable media such as memory or other type of storage devices. The term "computer readable media" is also used to represent carrier waves on which the software is transmitted. Further, such functions correspond to modules, which are software, hardware, firmware, or any combination thereof. Multiple functions are performed in one or more modules as desired, and the embodiments described are merely examples. The software is executed on a digital signal processor, ASIC, microprocessor, or other type of processor operating on a system, such as a personal computer, server, a router, or other device capable of processing data including network interconnection devices.

Some embodiments implement the functions in two or more specific interconnected hardware modules or devices with related control and data signals communicated between and through the modules, or as portions of an application-specific integrated circuit. Thus, the exemplary process flow is applicable to software, firmware, and hardware implementations.

FIG. 1 is a block diagram of a oil production facility 100 according to an example embodiment. The oil production facility typically includes multiple oil wells 102 that are each interconnect to a piping system 103. The piping system 103 includes a set of production valves and a set of test valves that may be set in combination to cause fluids pumped from a single well to be sent to a well test separator 112 over test line 106 and fluids from all of the other wells to be sent to a production separator 110 over production line 108.

The well test separator 112 operates to perform several functions including to separate oil and water pumped from the wells. The well test separator 112 further includes one or more measurement devices. The measurement devices may include a water meter 114 to measure an amount or rate of water extracted from a well and an emulsion meter 116 to meter an amount of oil extracted from the well. Further measurement devices may include an emulsion ratio analyzer system 118 and other devices typically utilized to monitor well performance. Some such other devices may include a wellhead pressure sensor, a thermometer, and yet further measurement devices.

The measurement from the well test separator 112 measurement devices are then communicated to a system that maintains historical records of well performance and monitors performance of each well. These measurements are typically encoded and sent over a data communication network to the system. An example of such a system is illustrated in FIG. 2.

Figure 2:
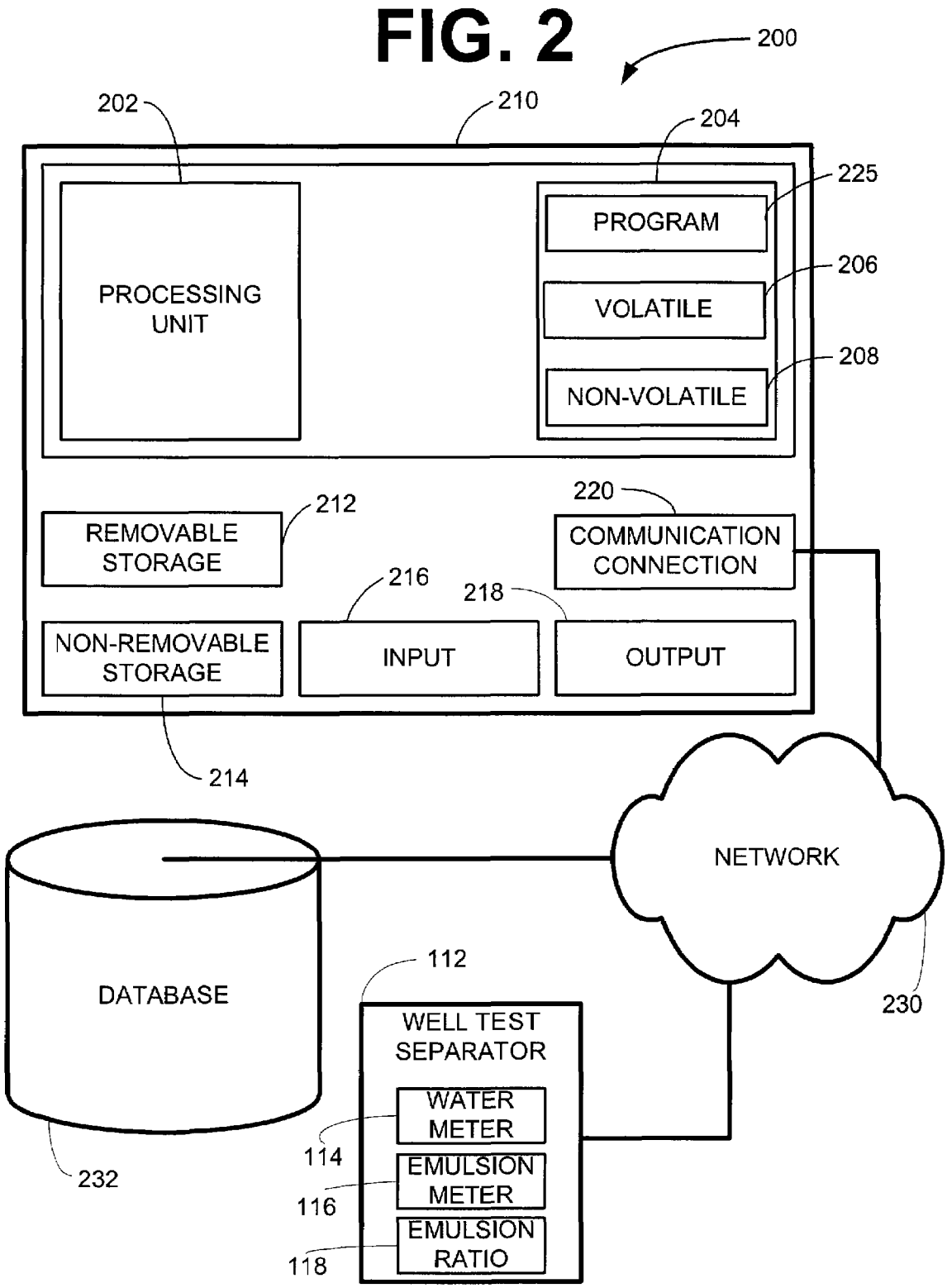
FIG. 2 is a block diagram of a computing device according to an example embodiment.

FIG. 2 is a block diagram of a computing device 200 according to an example embodiment. The computing device 200 is interconnected via a network 230 to the well test separator 112 and a database 232.

In one embodiment, multiple such computer systems 200 are utilized in a distributed network 230 to implement multiple components in a transaction based environment. An object oriented architecture may be used to implement such functions and communicate between the multiple systems and components. One example computing device in the form of a computer 210, may include a processing unit 202, memory 204, removable storage 212, and non-removable storage 214. Memory 204 may include volatile memory 206 and non-volatile memory 208. Computer 210 may include—or have access to a computing environment that includes—a variety of computer-readable media, such as volatile memory 206 and non-volatile memory 208, removable storage 212 and non-removable storage 214. Computer storage includes random access memory (RAM), read only memory (ROM), erasable programmable read-only memory (EPROM) & electrically erasable programmable read-only memory (EEPROM), flash memory or other memory technologies, compact disc read-only memory (CD ROM), Digital Versatile Disks (DVD) or other optical disk storage, magnetic cassettes, magnetic tape, magnetic disk storage or other magnetic storage devices, or any other medium capable of storing computer-readable instructions. Computer 210 may include or have access to a computing environment that includes input 216, output 218, and a communication connection 220. The computer may operate in a networked environment using a communication connection to connect to one or more remote computers, such as database servers. The remote computer may include a personal computer (PC), server, router, network PC, a peer device or other common network node, or the like. The communication connection may include a Local Area Network (LAN), a Wide Area Network (WAN) or other networks.

Computer-readable instructions stored on a computer-readable medium are executable by the processing unit 202 of the computer 210. A hard drive, CD-ROM, and RAM are some examples of articles including a computer-readable medium. The term "computer readable medium" is also used to represent carrier waves on which the software is transmitted. For example, a computer program 225 capable of providing a generic technique to perform access control check for data access and/or for doing an operation on one of the servers in a component object model (COM) based system according to the teachings of the present invention may be included on a CD-ROM and loaded from the CD-ROM to a hard drive. The computer-readable instructions allow computer 210 to provide generic access controls in a COM based computer network system having multiple users and servers.

In some embodiments, the computer-readable instructions include instructions to process well test results received from the well test separator 112 over the network 230. In some such embodiments, the test results that are received are stored in the database 232 and later presented to an oil production facility operator. The operator may view a graphical, or other, representation of the test results and make an annotation of all or a portion of one or more test results. Some such annotations indicate that a certain test, or portion of a test, is indicative of abnormal or normal well behavior. In some instances, such as when a test result is annotated as abnormal, a further annotation may be made to the test results indicating the type of fault causing the abnormality of the test. These annotation are then stored in the database 232 associated with their respective test results. These annotated test results may then be compared to new test results to identify a match, or close match, that can be utilized to automatically identify possible abnormal well behavior and potential causes.

Test results may also be grouped together over a period of time by the computer-readable instructions. For example, a set of test results measured over the course of a month may be grouped together. This grouping of test results may then be applied to a new test to identify if there is a significant deviation from a current production trend, such as a drop off in oil production from a certain well.

Figure 3:
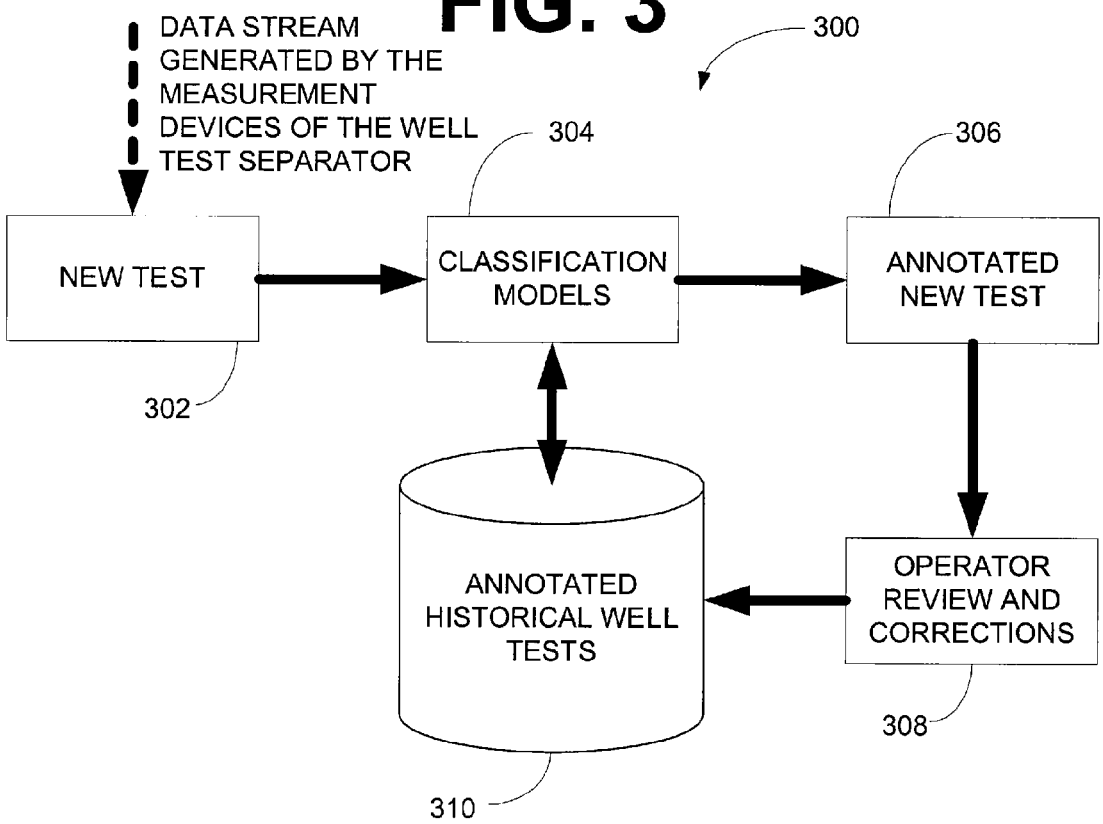
FIG. 3 is a logical block diagram of a system according to an example embodiment.

FIG. 3 is a logical block diagram of a system 300 according to an example embodiment. The system 300 operates by receiving a data stream generated by the one or more measurement devices of the well test separator 112. The data stream includes a new test 302. A set of classification models 304 retrieves records from the database of annotated historical well tests and compares them with the new test 302. The application of the classification models 304 may include applying one or more models to identify normality of the new test 302, consistency of the new test 302 with historical well trends, and specific faults of the new test 302.

After the classification models 304 are applied to the new test 302, the new test 302 is annotated to indicate the results of the classification model 304 application. This produces the annotated new test 306. The annotated new test 306 is then forwarded on either to the annotated historical wells tests database 310 or to an operator to review and make corrections. The correction may include modification of one or more oil production facility control settings or correction to one or more annotation made by the application of the classification models 304 to the new test 302. The annotated new test 306 is then stored in the annotated historical well tests database 310. As a result of correction to the one or more annotations of annotated new test 306, the classification models operative with the annotated historical well tests database 310 are adaptive.

FIG. 4 is a block diagram of a method 400 according to an example embodiment. The example method 400 is a method of oil well test classification. The example method includes receiving a first set of oil well test results from one or more measurement devices of a well test separator 402 and storing the first set of oil well test results in a database 404. In some embodiments, the method 400 further includes receiving an annotation of at least a portion of one or more tests of the first set oil well test results and storing the annotation in the database with an association to the respective test portions of the first set of oil well test results 406. This results in a set of classified test features that can be used by the classification models and applied to new oil well test results to identify current oil well conditions, faults, and trends.

In some embodiments, the method 400 then includes receiving a second set of oil well test results from the one or more measurement devices of the well test separator 408 and comparing the second set of oil well test results with the annotated test results to identify one or more closest matches 410. Such embodiments further include labeling one or more portions of the second set of oil well test results with the annotations of the identified closest matches 412 and outputting the label of the second set of oil well test results 414, such a causing the annotations to be displayed within a user interface. In some embodiments, multiple labels may be output and displayed to a user.

Figure 5:
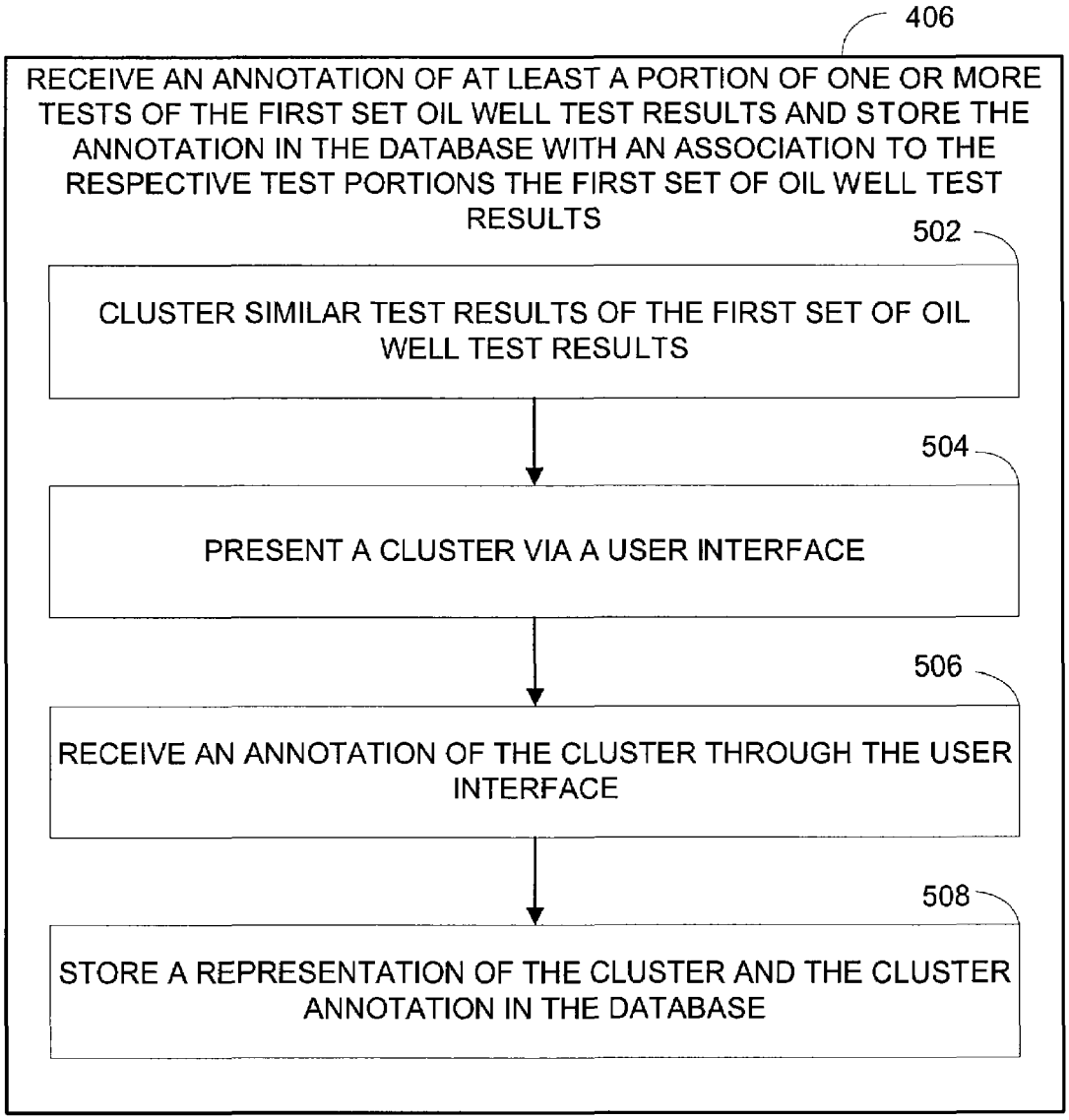
FIG. 5 is a block diagram of a method according to an example embodiment.

FIG. 5 is a block diagram of a method according to an example embodiment and provides further detail of receiving an annotation of at least a portion of one or more tests of the first set oil well test results and storing the annotation in the database with an association to the respective test portions the first set of oil well test results 406, according to some embodiments. Such embodiments include clustering similar test results of the first set of oil well test results 502 and presenting a cluster via a user interface 504. These embodiments also include receiving an annotation of the cluster through the user interface 506 and storing a representation of the cluster and the cluster annotation in the database 508.

In some further embodiments, the comparing of the second set of oil well test results with the annotated test results 410 includes dividing the entire time interval of each cluster of oil well test results and computing one or more aggregated statistical characteristics of each respective cluster. Then, when a new test result is received, dividing the entire time interval of second set of test results into a number of smaller intervals, such as equal intervals the clusters of oil well test results, and computing statistical characteristics over those intervals. In such embodiments, the method 400 includes comparing the computed characteristics of the second set of oil well test results with each of the computed aggregated characteristics of the clusters to identify a label of a cluster that most closely matches the second set of oil well test results.

In some embodiments, the method 400 may also include receiving, via the user interface, input that rejects the label of the identified portion of the second set of test results and receiving a new annotation of second set of test results. This new annotation may be stored in the database and used in subsequent comparisons of new oil well test results.

Figure 6A:
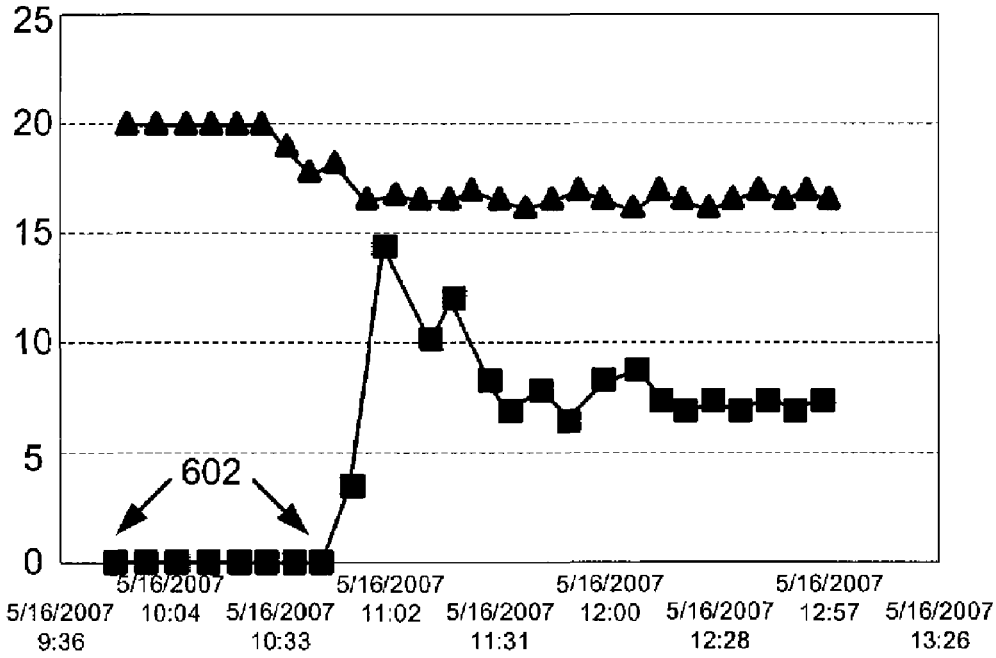
FIG. 6A is a diagram of oil well test results according to an example embodiment.
Figure 6B:
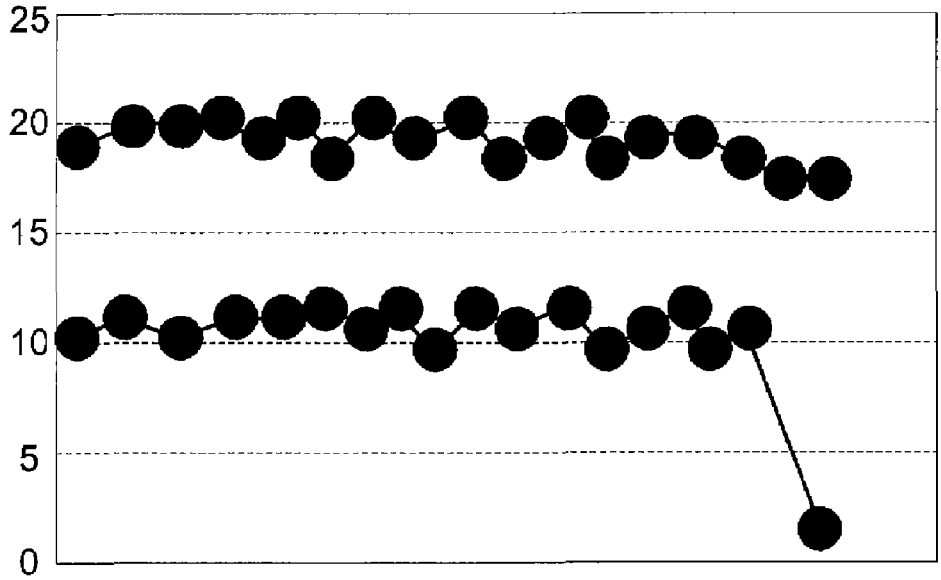
FIG. 6B is a diagram of oil well test results according to an example embodiment.
Figure 6C:
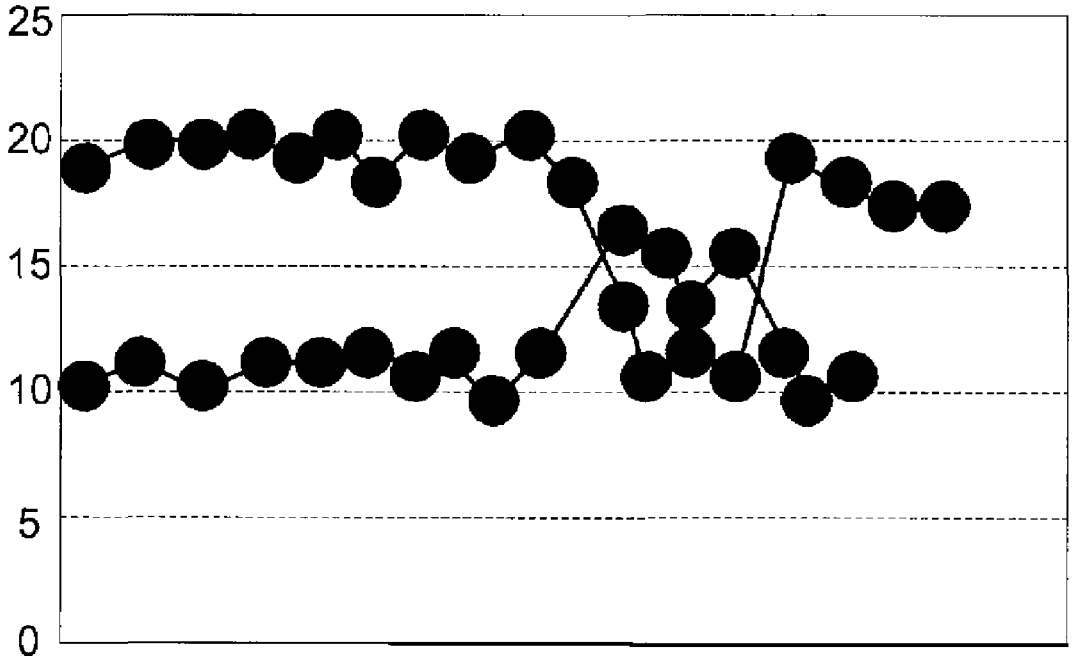
FIG. 6C is a diagram of oil well test results according to an example embodiment.

FIGS. 6A-6C are diagrams of oil well test results according to example embodiments. The diagram of FIG. 6A illustrates a normal oil well test, or more simply, is a curve of expected oil and water flow rates. Note that between references 602, the oil level is zero. This can be identified and annotated as to be ignored, in this case due to normal purging.

Application of a classification model that works with data as illustrated in FIG. 6A compares a time series of observed data during the current test with historical tests. This enables recognition of test-internal problems and faults.

Some embodiments of the method 400, including historical trend analysis, include storing the results of each oil well test in the database with data identifying when the test was performed and applying a classification model to the historical trend of oil well test results. A representation of historical trend is illustrated in FIG. 6B. Beyond the oil and water rates, the classification model may include arbitrary number of other relevant parameters such as wellhead pressure or temperature, which provides a classification model that is multidimensional nature. The method 400 in such embodiments further includes comparing the second set of oil well test results with the historical trend to determine if an oil well test conforms to the historical trend. This may include plotting a new test to the trend, such as the model illustrated in FIG. 6B wherein the lower right hand plotting of test results can be seen as deviating significantly from the historical trend of data. The method 400 then outputs an indication of oil well test consistency.

In some embodiments of the method 400 that include classification models to detect specific features in oil well test results, the method 400 includes receiving an annotation of at least a portion of one or more tests of the first set oil well test results. This may include receiving an annotation of a oil well test data feature such as the feature illustrated in FIG. 6C. The example of FIG. 6C illustrates two plotted data streams. The upper data stream is an oil flow rate and the lower data stream is a water flow rate. The feature show by the intersection of the two data streams is indicative of water in the oil leg which is indicated by a water level above the norm and an oil level below the norm. Other features may be indicated by different data streams. When such a feature is identified and annotated in a historical data set, application of a classification model based on such an annotation can be utilized to identify such features in newly performed tests.

It is emphasized that the Abstract is provided to comply with 37 C.F.R. §1.72(b) requiring an Abstract that will allow the reader to quickly ascertain the nature and gist of the technical disclosure. It is submitted with the understanding that it will not be used to interpret or limit the scope or meaning of the claims.

In the foregoing Detailed Description, various features are grouped together in a single embodiment to streamline the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

It will be readily understood to those skilled in the art that various other changes in the details, material, and arrangements of the parts and method stages which have been described and illustrated in order to explain the nature of this invention may be made without departing from the principles and scope of the invention as expressed in the subjoined claims.

What is claimed is:

1. A method of oil well test classification comprising:

receiving a first set of oil well test results from one or more measurement devices of a well test separator;

storing the first set of oil well test results in a database;

receiving an annotation of at least a portion of one or more tests of the first set oil well test results and storing the annotation in the database with an association to the respective test portions the first set of oil well test results;

receiving a second set of oil well test results from the one or more measurement devices of the well test separator;

comparing the second set of oil well test results with the annotated test results to identify one or more closest matches;

labeling one or more portions of the second set of oil well test results with the annotations of the identified closest matches; and outputting the label of the second set of oil well test results.

2. The method of claim 1, further comprising:

clustering similar test results of the first set of oil well test results;

presenting a cluster via a user interface;

receiving an annotation of the cluster through the user interface; and storing a representation of the cluster and the cluster annotation in the database.

3. The method of claim 2, wherein the comparing of the second set of oil well test results with the annotated test results includes:

dividing the entire time interval of each cluster of oil well test results and computing aggregated statistical characteristics of each respective cluster;

dividing the entire time interval of second set of test results into a number of smaller intervals and computing statistical characteristics over those intervals; and comparing the computed characteristics of the second set of oil well test results with each of the computed aggregated characteristics of the clusters to identify a label of a cluster that most closely matches the second set of oil well test results.

4. The method of claim 1, wherein outputting the label of the second set of oil well test results includes:

presenting the label with an identified portion of the second set of test results via a user interface.

5. The method of claim 4, further comprising:

receiving, via the user interface, input that rejects the label of the identified portion of the second set of test results;

receiving a new annotation of second set of test results; and storing the new annotation of the second set of test results in the database, wherein the new annotation and the second set of test results are included in subsequent comparing of oil well test results to identify a test result label.

6. The method of claim 1, wherein a set of oil well test results includes a water output measurement and an oil output measurement each measurement made at several points in time over the course of an oil well test.

7. The method of claim 1, further comprising:

storing the results of each oil well test in the database with data identifying when the test was performed;

generating a historical trend model of oil well test results;

comparing the second set of oil well test results with the historical trend model to determine if an oil well test conforms to the historical trend model; and outputting an indication of oil well test normality.

8. The method of claim 1, wherein receiving an annotation of at least a portion of one or more tests of the first set oil well test results includes receiving an annotation of at least a portion of an oil well test result indicative of a test feature.

9. A machine-readable medium encoded with instructions, which when processed, cause a suitably configured machine to classify oil well test results by:

receiving a first set of oil well test results from one or more measurement devices of a well test separator;

storing the first set of oil well test results in a database;

receiving an annotation of at least a portion of one or more tests of the first set oil well test results and storing the annotation in the database with an association to the respective test portions the first set of oil well test results;

receiving a second set of oil well test results from the one or more measurement devices of the well test separator;

comparing the second set of oil well test results with the annotated test results to identify one or more closest matches;

labeling one or more portions of the second set of oil well test results with the annotations of the identified closest matches; and outputting the label of the second set of oil well test results.

10. The machine-readable medium of claim 9, with further instruction, which when processed, further causes the machine to classify oil well test results by:

clustering similar test results of the first set of oil well test results;

presenting a cluster via a user interface;

receiving an annotation of the cluster through the user interface; and storing a representation of the cluster and the cluster annotation in the database.

11. The machine-readable medium of claim 10, wherein the comparing of the second set of oil well test results with the annotated test results includes:

dividing the entire time interval of each cluster of oil well test results and computing aggregated average values of each respective cluster;

dividing the entire time interval of second set of test results into a number of smaller intervals and computing an average value over those intervals; and comparing the computed averages of the second set of oil well test results with each of the computed aggregated averages of the clusters to identify a label of a cluster that most closely matches the second set of oil well test results.

12. The machine-readable medium of claim 9, wherein outputting the label of the second set of oil well test results includes:

presenting the label with an identified portion of the second set of test results via a user interface.

13. The machine-readable medium of claim 12, with further instruction, which when processed, further causes the machine to classify oil well test results by:

receiving, via the user interface, input that rejects the label of the identified portion of the second set of test results;

receiving a new annotation of second set of test results; and storing the new annotation of the second set of test results in the database, wherein the new annotation and the second set of test results are included in subsequent comparing of oil well test results to identify a test result label.

14. The machine-readable medium of claim 9, wherein a set of oil well test results includes a water output measurement and an oil output measurement each measurement made at several points in time over the course of an oil well test.

15. The machine-readable medium of claim 9, with further instruction, which when processed, further causes the machine to classify oil well test results by:

storing the results of each oil well test in the database with data identifying when the test was performed;

generating a historical trend model of oil well test results;

comparing the second set of oil well test results with the historical trend model to determine if an oil well test conforms to the historical trend model; and outputting an indication of oil well test normality.

16. The machine-readable medium of claim 9, wherein receiving an annotation of at least a portion of one or more tests of the first set oil well test results includes receiving an annotation of at least a portion of an oil well test result indicative of a test feature.

* * * * *